United States Patent [19]

Oboza

[11] Patent Number: 4,658,547

[45] Date of Patent: Apr. 21, 1987

[54] CAM BIASED PIVOTING DOOR

[75] Inventor: Andrew J. Oboza, Niles, Ill.

[73] Assignee: Zenith Electronics Corporation, Glenview, Ill.

[21] Appl. No.: 769,812

[22] Filed: Aug. 26, 1985

[51] Int. Cl.[4] ..... E05F 1/10

[52] U.S. Cl. ..... 49/386; 16/341; 16/337

[58] Field of Search ..... 16/225, 337, 341, 342, 16/363, DIG. 13, 333; 49/386, 389, 388; 248/240

[56] References Cited

U.S. PATENT DOCUMENTS 4,268,146 5/1981 Johnson ..... 16/341

*Primary Examiner*—Kenneth J. Dorner

*Assistant Examiner*—Gerald A. Anderson

[57] ABSTRACT

A door includes a pair of pivot pins each positioned on the outer surface of a respective, facing edge-mounted resilient flange. Each resilient flange is adapted for flexible displacement relative to facing lateral portions of a support panel in which the door is to be mounted, while each pivot pin is adapted for insertion within a respective mounting aperture in each of said support panel facing portions. Each support panel facing portion is provided with a ramp positioned adjacent to a respective mounting aperture, with the taper of the ramps providing decreasing inter-ramp spacing in the direction of pivoting displacement of the door as it is opened. Positioned adjacent to each of the pivot pins on the outer lateral surface of each resilient flange and arranged so as to engage a corresponding ramp is a cam having a first beveled and a second flat outer surface.

14 Claims, 9 Drawing Figures

CAM BIASED PIVOTING DOOR

BACKGROUND OF THE INVENTION

This invention relates generally to pivoting doors and is particularly directed to a snap-acting door mounting arrangement for securely maintaining a pivoting door in either a closed or an open position.

Pivoting doors are frequently used in electronic apparatus to cover a control panel. This is particularly the case in consumer-type electronic products where the controls are frequently positioned behind a movable door in order to limit access to the controls when the electronic apparatus is not in use as well as to improve its appearance. Where the door is of the pivoting type, certain design and operating criteria are particularly desirable. For example, the door should be easily installed and inexpensively manufactured. Its pivotal mounting configuration should involve a minimal number of components all of which should be low in cost and of simple design. Thus, the use of springs, magnets or latches, as frequently encountered in the prior art, is highly undesirable from the standpoint of increased complexity and expense as well as reduced reliability. In addition, a separate hinge mechanism is undesirable since this too involves an additional component, or components, with the hinge itself requiring a separate installation procedure. The pivoting door in combination with its mounting arrangement should also be easily manipulated, structurally strong, and not easily broken. Finally, the door mounting arrangement should be capable of maintaining the door in both the full open and full closed positions in a stable manner and should provide for the self-closure of the door when it is oriented in an intermediate position.

The present invention provides a hinged door arrangement particularly adapted for use with the control panel of an electronic apparatus which possesses all of the aforementioned characteristics and is comprised of just two components—a pivoting door and a support panel to which it is easily, yet securely mounted.

OBJECTS OF THE INVENTION

Accordingly, it is an object of the present invention to provide a door mounting arrangement for a pivoting door which maintains the door stably in either the open or closed position.

It is another object of the present invention to provide a snap-acting door mounting arrangement for a vertically pivoted door.

Yet another object of the present invention is to provide for the secure and stable positioning of a vertically pivoting door when opened to a generally horizontal orientation and which biases the door closed when oriented in an intermediate position.

A further object of the present invention is to provide a pivoting mount arrangement for maintaining a door in an open position where the door is urged closed by a resilient conductor strip coupled to electronic circuitry positioned on the door.

A still further object of the present invention is to provide a low cost hinged door arrangement having a minimum number of components which is reliable, easily fabricated and easily assembled.

Another object of the present invention is to provide a pivoting door arrangement which biases the door to the closed position while allowing it to be easily opened and remain stably in the full open position.

It is another object of the present invention to provide a hinged door construction wherein the hinge mechanism is integral with the door and its supporting structure and which does not make use of springs, magnets, latches, or a separate hinge mechanism.

Yet another object of the present invention is to provide a hinged door arrangement which is comprised of only two elements—the door and its supporting structure.

A further object of the present invention is to provide a hinged door particularly adapted for use in electronic control panels.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
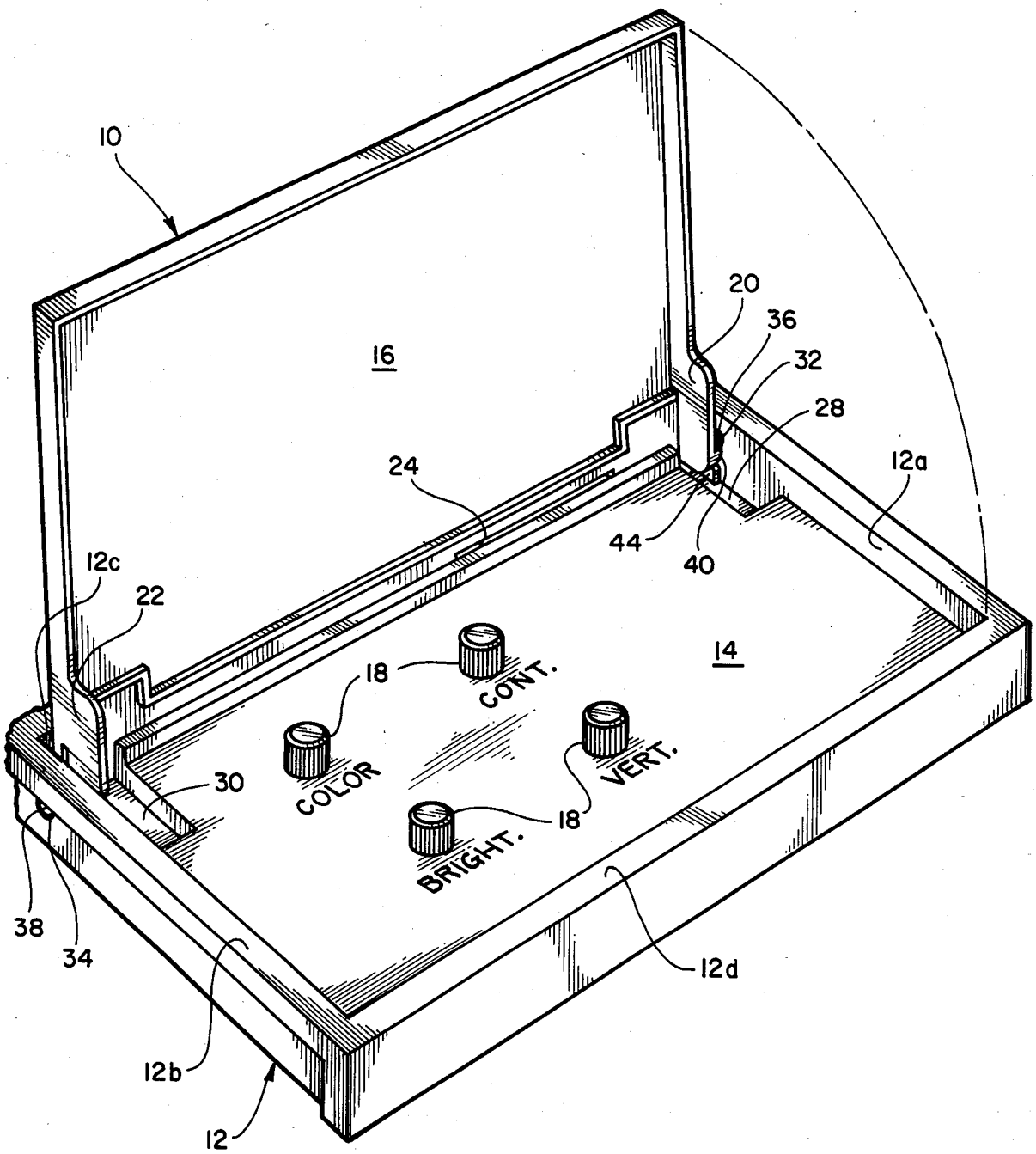
FIG. 1 is a perspective view of a support panel to which a door is pivotally mounted in accordance with the present invention wherein the door is shown in the open position.
Figure 2:
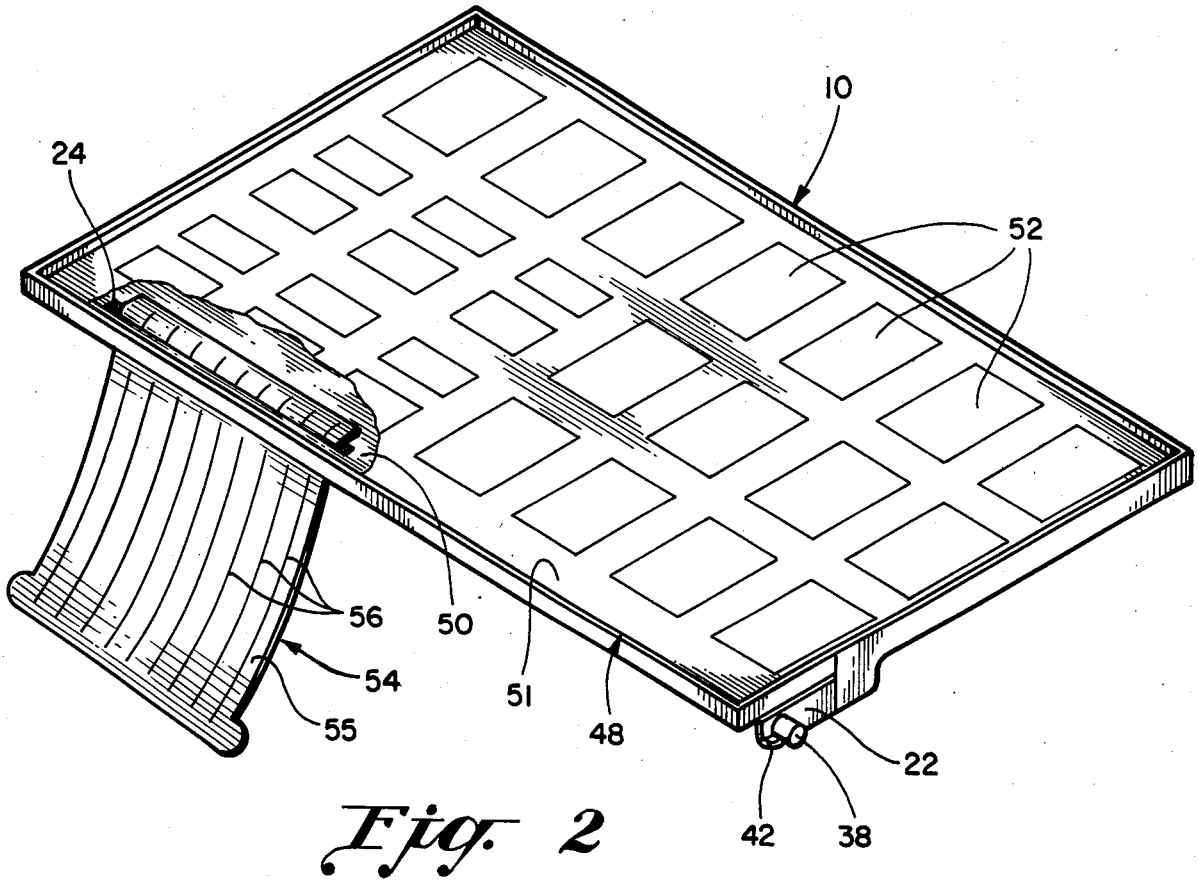
FIG. 2 is a perspective view of a cam biased pivoting door in accordance with the present invention having electronic circuitry positioned on one side thereof and an electrical conductor inserted therethrough.
Figure 3:
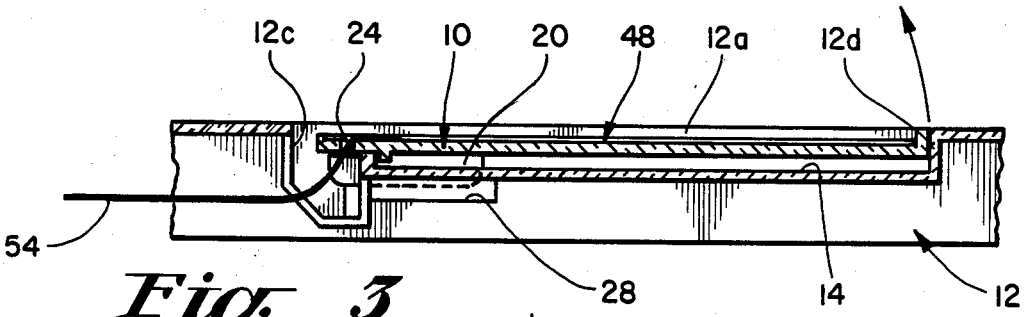
FIG. 3 is a sectional view of the cam biased pivoting door mounting arrangement FIG. 1 wherein the door is shown in the closed position.

Referring to FIGS. 1, 2 and 3, there is shown a cam biased pivoting door 10 in accordance with the present invention. The perspective and sectional views of FIGS. 1 and 3 respectively illustrate the pivoting door in the open and closed positions, while FIG. 2 is a perspective view of the pivoting door 10 illustrating a portion of the mounting structure for positioning the pivoting door on a support panel 12.

As shown in FIG. 1, the support panel 12 includes a recessed portion 14. The recessed portion 14 of the support panel 12 is defined by right and left lateral portions 12*a*, 12*b* as well as upper and lower portions 12*c*, 12*d* of the support panel. With the door 10 in the closed position, the inner surface 16 of the door is aligned generally parallel with and closely spaced from the recessed portion 14 of the support panel 12. Positioned upon the flat recessed portion 14 of the support panel 12 may be a plurality of control elements 18 for exercising control over an electronic device such as a television receiver. In this situation, the support panel 12 would typically form a portion of the electronic device's cabinet (not shown). Thus, with the door 10 closed, the control elements or selectors 18 are positioned behind the door 10 and are maintained out of sight for improved aesthetics and access to these control elements is restricted when not in use.

The door 10 is provided with right and left resilient flanges 20, 22 positioned on respective lateral portions of the door. The terms "right" and "left" as used herein are taken with the door 10 and support panel 12 viewed from the front or from the direction in which the door pivots between its open and closed positions. Each of the resilient flanges 20, 22 is free to flex upon deflection toward and away from one another or in a direction generally parallel to the plane of the door 10. Positioned on the respective outer surfaces of the right and left flanges 20, 22 and extending therefrom are right and left pivot pins 36, 38. The right and left flanges 20, 22 are adapted for positioning within respective right and left slots 28, 30 located in respective upper corners of the recessed portion 14 of the support panel 12.

Positioned in the right and left lateral portions 12*a*, 12*b* of the support panel 12 immediately adjacent to the right and left slots 28, 30 and outward therefrom are right and left mounting apertures 32, 34. Each of the right and left mounting apertures 32, 34 is generally circular in cross section and is adapted to receive a respective right and left pivot pin 36, 38 positioned upon the aforementioned resilient flanges. The right and left mounting apertures 32, 34 are generally aligned along a common axis about which the door 10 is free to pivot with the right and left mounting pins 36, 38 positioned within a respective one of the aforementioned mounting apertures. Sufficient clearance is provided between those portions of the recessed portion 14 of the support panel 12 defining the right and left slots 28, 30 therein and the right and left flanges 20, 22 to permit free pivoting displacement of the door 10 within the support panel. The door 10 is attached to the support panel 12 by inserting one of the pivot pins in a corresponding mounting aperture and inwardly deflecting the flange from which the other pivot pin extends outward to allow the latter pivot pin to be inserted in its associated mounting aperture. Therefore, the resilience of each of the flanges 20, 22 permits the door 10 to be positioned upon and removed from the support panel 12.

Referring specifically to FIGS. 2 and 3, there is shown an electronic switch assembly 48 positioned upon the outer surface of the door 10. The switch assembly 48 includes an inner conductive layer 50 and an outer insulating layer 51. The outer insulating layer 51 includes a plurality of switch elements or selectors 52 positioned thereon. Each of the switch elements 52 includes a conductive inner portion (not shown) adapted to engage and contact the inner conductive layer 50 when engaged and depressed such as by the finger of an operator. The inner conductive layer 50 includes a plurality of conductive leads 56 which are arranged in a given circuit pattern in accordance with the arrangement of switch elements in the switch assembly 48. The switch assembly 48 thus far described is commonly referred to as a "membrane switch matrix" and is conventional in design and operation. One end of a conductor 54 is securely affixed to the inner conductive layer 50 of the switch assembly 48. The conductor 54 is comprised of a substrate 55 and a plurality of the aforementioned conductive leads 56 positioned thereon. The conductor 54 is adapted for electrically coupling the switch assembly 48 to additional circuitry (not shown) for the processing of the user-initiated signals generated by engagement of the various switch elements 52 positioned on the outer insulating layer 51 of the switch assembly 48.

As shown in FIGS. 2 and 3, the conductor 54 is positioned within and extends through an elongated slot 24 within the door 10. By thus positioning the conductor 54 so as to extend through the door 10, the switch assmbly 48 positioned on an outer surface of the door may be electrically coupled to other circuitry (not shown) which is positioned within a cabinet of which the support panel 12 forms a portion. The substrate portion 55 of the conductor 54 is typically comprised of a resilient material which allows the conductor to flex and to be adapted to a wide range of wire runs. As shown in FIG. 3, the conductor 54 is generally maintained in the least biased, or bent, configuration when the door 10 is closed. Therefore, the resilient conductor 54 tends to bias the door 10 to the closed position. Opening of the door 10 is opposed by the resilient conductor 54, which is overcome by the cam biased pivoting door arrangement of the present invention as described in detail below for allowing the door to remain securely and stably in an open position. In addition, where the support panel 12 is oriented generally vertically, the weight of the door 10 also biases the door to the closed position. The cam biased pivoting door arrangement of the present invention also counteracts this biasing influence on the open door to allow it to remain open in a stable and secure manner. However, it should be noted here that the cam biased pivoting door arrangement of the present invention is not limited to use with a resilient conductor inserted through the door nor does it require that the door be oriented so as to pivot in a generally vertical direction.

Figure 5:
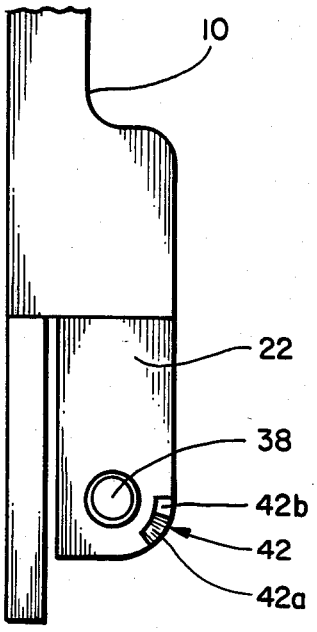
FIG. 5 is a lateral view of a portion of the pivoting door illustrating details of the mounting arrangement therefor.
Figure 6:
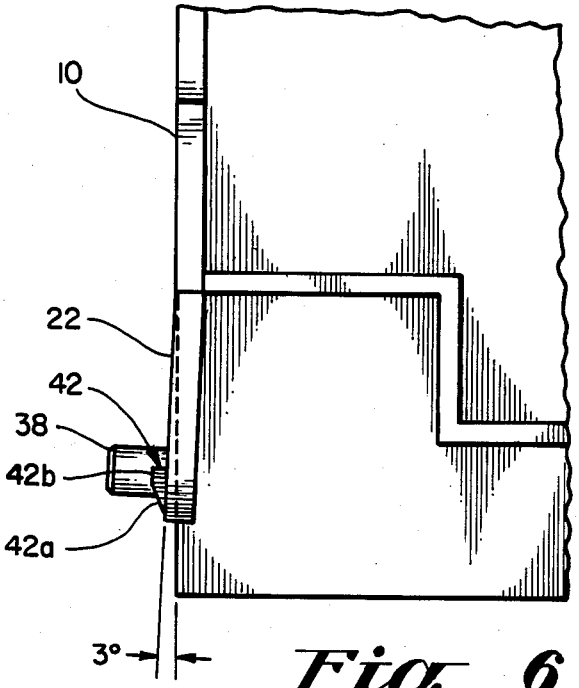
FIG. 6 is a plan view of the mounting arrangement for the pivoting door of the present invention as shown in FIG. 5.

The cam biased pivoting door 10 positioned upon the support panel 12 is biased to the closed position and is maintained in the fully open position in the following manner. The respective outer surfaces of each of the right and left flanges 20, 22 are provided with respective right and left cams 40, 42. The right cam 40 is positioned on the outer surface of the right flange 20 adjacent to the right pivot pin 36 thereon. Similarly, the left cam 42 is positioned on the outer surface of the left flange 22 adjacent to the left pivot pin 38 thereon. Each of the right and left cams includes a first flat portion and a second tapered portion. This is shown specifically in FIGS. 5 and 6 for the case of the left cam 42 which is shown as including a first beveled or tapered portion 42*a* and a second flat portion 42*b*. With the door 10 in the closed position, the flat portions of each of the right and left cams 40, 42 engages a respective end portion of the right and left tapered ramps 44, 46. This end portion of the right tapered ramp 44 which is engaged by the second flat portion of the right cam 40 when the door is closed is shown as element 44*a* in FIG. 4. In a preferred embodiment, each of the resilient flanges is angled outward from an adjacent lateral edge of the door 10 at an angle of 3° as shown for the case of the left flange in FIG. 6.

Figure 9:
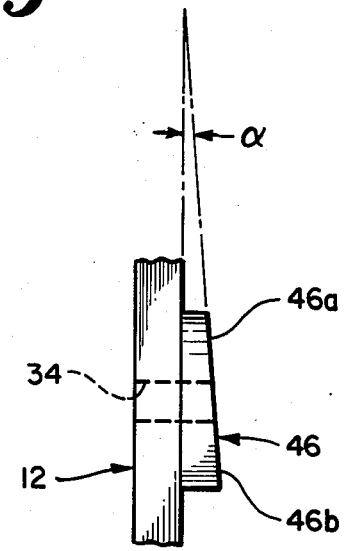
FIG. 9 illustrates the tapered nature of each of the ramps positioned on facing portions of the support panel to which the pivoting door is mounted.
Figures 4, 7, 8:
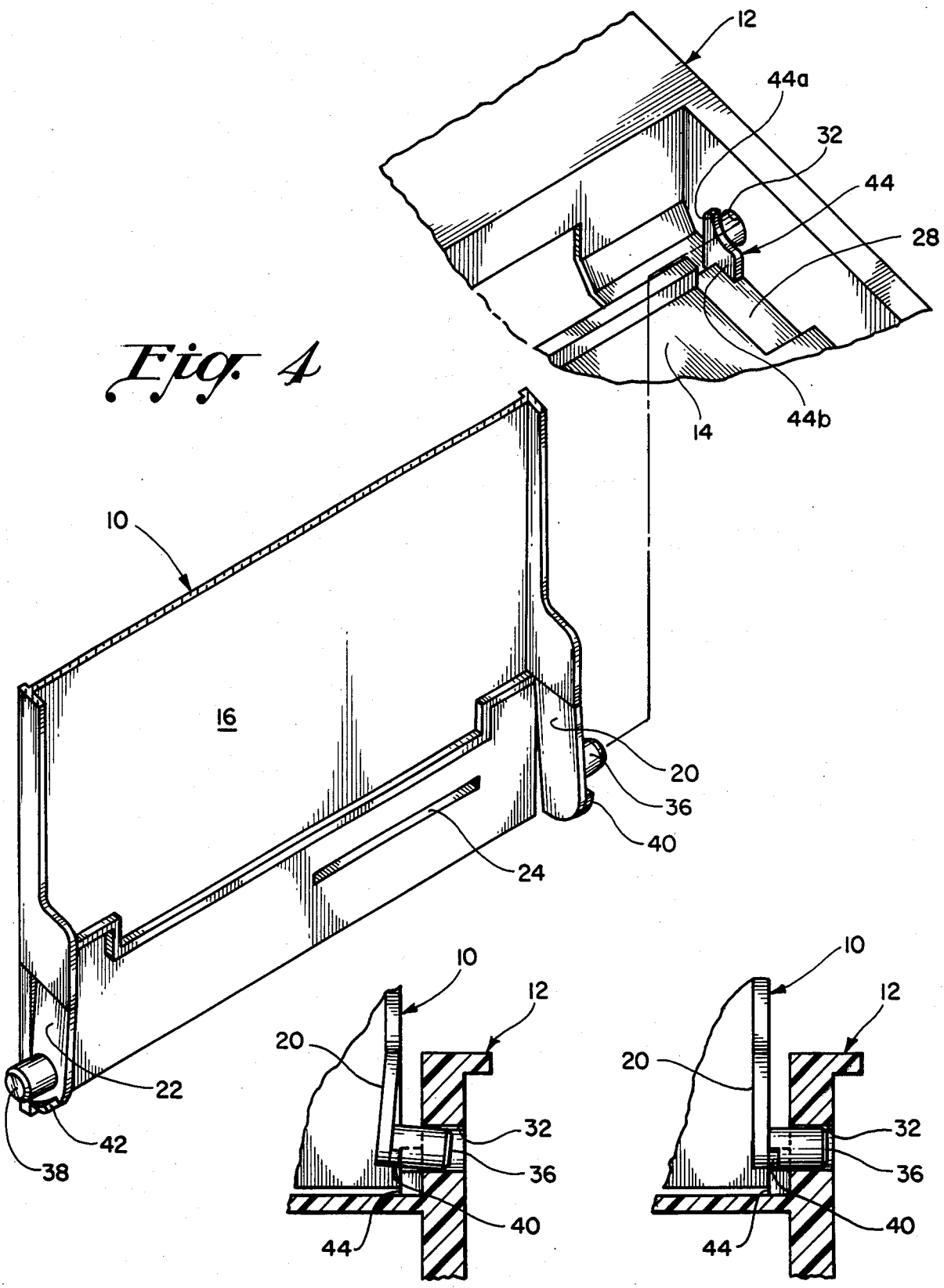
FIG. 4 is an exploded perspective view of the combination of a pivoting door and a support panel therefor in accordance with the present invention illustrating the details of a portion of the cam biased mounting arrangement.
FIG. 7 illustrates the coupling between the pivoting door and the supporting panel during the opening and closing of the door.
FIG. 8 illustrates the coupling between the door and its support panel with the door in the full open position.

Each of the right and left ramps 44, 46 further includes a second end portion which is shown as element 44*b* for the right tapered ramp 44 in FIG. 4. The corresponding aforementioned first and second end portions of the left ramp 46 are respectively shown as elements 46*a* and 46*b* in FIG. 9. The tapered nature of the left ramp is shown by the angle $\alpha$ in the figure. The second end portions of each of the right and left tapered ramps 44, 46 are thicker than the aforementioned respective first end portions thereof. This is shown in FIG. 9 for the case of the left tapered ramp 46 wherein the second end portion 46*b* thereof possesses a greater thickness than the first end portion 46*a* thereof. With a respective second flat portion of the right and left cams 40, 42 engaging the first end portions 44*a*, 46*a* of the right and left ramps 44, 46 when the door 10 is closed, opening of the door will cause each of the aforementioned cams to be displaced along a respective tapered ramp in the direction of increasing ramp thickness or toward the respective second ends 44*b*, 46*b* thereof. The decreasing separation between the right and left ramps 44, 46 arising from their tapered configuration opposes displacement of the door toward the open position and results in the inward deflection of the right and left flanges 20, 22 as shown for the case of the right flange in FIG. 7. The tendency of the right and left flanges 20, 22 to assume a nonflexed configuration opposes further opening of the door 10 and biases the door to the closed position whereat the flexure of the right and left flanges is minimal or may even be eliminated where the door is oriented generally vertically when closed or faces in an upward direction when closed.

As the door 10 is rotated toward the full open position, the increasing thicknesses of the right and left tapered ramps 44, 46 increasingly opposes the opening of the door with an increasing biasing force toward the closed position. Continued pivotal displacement of the door toward the full open position results in the positioning of the respective second flat portions of the right and left cams 40, 42 upon and in contact with the thicker second ends 44*b*, 46*b* of the right and left ramps 44, 46. Further displacement of the door 10 toward the full open position, will result in the engagement of the respective first beveled portions 40*a*, 42*a* of the right and left cams 40, 42 with the respective edges of the right and left ramps 44, 46 immediately adjacent to the second thicker ends 44*b*, 46*b* thereof. The angled nature of the first beveled portions 40*a*, 42*a* of the right and left cams 40, 42 and their interaction with the respective edges of the thicker end portions of the right and left ramps 44, 46 urges the door 10 to the full open position. The resilient nature of each of the right and left flanges 20, 22 urges each of the right and left cams 40, 42 outward whereupon the position of each of the cams is maintained immediately adjacent to the respective thicker portion of the right and left ramps 44, 46 for maintaining the door 10 in the full open position.

In closing the door 10, the door is manually displaced toward the closed position whereupon the first beveled portions of each of the right and left cams 40, 42 engage a respective edge of the right and left ramps 44, 46 adjacent to the thicker second end portions thereof. Continued displacement of the door toward the closed position, results in the positioning of each of the second flat portions of the right and left cams 40, 42 in contact with the thicker second end portions 44*b*, 46*b* of the right and left ramps 44, 46. The tapered nature of the ramps urges each of the right and left cams 40, 42 toward the respective first thinner end portions 44*a*, 46*a* of each of the tapered ramps. By thus urging each of the right and left cams 40, 42 toward the respective first thinner ends of the right and left ramps 44, 46, the door 10 is biased to the closed position.

There has thus been shown a cam biased pivoting door arrangement for biasing a pivoting door to the closed position until it is moved to an orientation closely approaching that of the fully open position whereupon the door is urged to and maintained in the full open position. The cam biased pivoting door is particularly adapted for use with an electronic control panel which may be mounted on the door and through which a resilient elongated strip conductor may be inserted for electrically coupling the control panel to an electronic apparatus.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An arrangement for pivotally mounting a door in a support panel comprising:

resilient means positioned on the door and adapted for flexible deflection toward and away from an adjacent portion of the support panel;

pivot means positioned on a lateral portion of said resilient means and in facing relation to the adjacent portion of the support panel;

receiving means positioned on the adjacent portion of the support panel for engaging said pivot means in pivotally coupling the door to the support panel;

ramp means including first and second tapered members respectively positioned on facing portions of the support panel adjacent to said receiving means; and curvilinear cam means positioned on said resilient means adjacent to said pivot means so as to engage said ramp means when said receiving means engages said pivot means, wherein a concave portion of said curvilinear cam means is positioned in facing relation to said pivot means on said resilient means, said cam means including a first portion engaging said ramp means when the door is intermediately positioned between an open and a closed position for biasing the door to the closed position and a second portion engaging said ramp means when the door is in a substantially open position for biasing the door in a snap-acting manner to a full open position.

2. The arrangement of claim 1 wherein said receiving means includes a pair of spaced apertures positioned in the support panel.

3. The arrangement of claim 2 wherein said pair of spaced apertures are in mutual alignment and are positioned in respective facing portions of the support panel.

4. The arrangement of claim 3 wherein said resilient means includes a pair of spaced resiliently flexible flanges each positioned on a respective lateral portion of the door.

5. The arrangement of claim 4 wherein each of said flanges is flexibly displaceable toward and away from a portion of the support frame adjacent to a respective lateral portion of the door.

6. The arrangement of claim 5 wherein the spacing between said tapered members decreases in the direction the door is displaced toward the open position.

7. The arrangement of claim 6 wherein each of said tapered members engages a respective cam means for increasing the flexible displacement of an associated flange as the door is displaced toward the open position whereupon said cam means no longer displace a respective flange allowing said flanges to assume a non-flexed configuration when the door is in the substantially open position.

8. The arrangement of claim 7 wherein said cam means includes a pair of cams each positioned on a respective resilient flange adjacent to a pivot pin thereon and wherein each cam includes a generally flat first portion and a beveled second portion.

9. The arrangement of claim 8 wherein engagement between the beveled second portions of each of said cams and said ramp means maintains the door in the full open position.

10. The arrangement of claim 9 wherein the beveled second portion of each cam engages an edge of a respective tapered member when the door is in the substantially open position whereupon the door is biased to the full open position in a snap-acting manner.

11. The arrangement of claim 1 wherein the door includes an aperture therein through which a resiliently flexible conductor extends and wherein an electronic circuit is positioned on the door and is electrically coupled to the flexible conductor.

12. The arrangement of claim 11 wherein the door is further biased to the closed position by the flexible conductor inserted therethrough.

13. The arrangement of claim 12 wherein the support panel is oriented generally vertically and the door is further biased to the closed position by the weight thereof.

14. An arrangement for pivotally mounting a door in a support panel comprising:

first and second apertures positioned in lateral facing portions of the support panel;

first and second resilient members positioned in a facing manner on respective lateral portions of the door and including first and second pivot pins respectively positioned thereon and adapted for insertion in said first and second apertures, respectively;

first and second tapered ramps positioned on the lateral facing portions of the support panel adjacent to said first and second apertures, respectively; and first and second curvilinear cams each including a respective concave portion and respectively positioned on said first and second resilient members adjacent to said first and second pivot pins with the concave portion of each of said curvilinear cams positioned in facing relation with an associated adjacent pivot pin and adapted to engage said first and second ramps, respectively, with each of said cams including a first beveled portion and a second flat portion, wherein said second flat cam portions engage a respective ramp during the opening and closing of the door whereby the door is urged to a closed position and wherein said first beveled cam portions engage a respective ramp when the door is in a substantially open position whereby the door is urged to a full open position in a snap-acting manner.

* * * * *